US005332180A

United States Patent [19]

Peterson et al.

[11] Patent Number: 5,332,180

[45] Date of Patent: Jul. 26, 1994

[54] TRAFFIC CONTROL SYSTEM UTILIZING ON-BOARD VEHICLE INFORMATION MEASUREMENT APPARATUS

[75] Inventors: Robert A. Peterson, Pittsburgh; Theo C. Giras, Harmanville; Larry C. Mackey, Unity Township, Westmoreland County; Daniel R. Disk, Murrysville, all of Pa.; Robert G. Brown, Hillpoint, Wis.; Barry W. Johnson, Charlottesville, Va.; Joseph A. Profeta, Pittsburgh, Pa.

[73] Assignee: Union Switch & Signal Inc., Pittsburgh, Pa.

[21] Appl. No.: 997,603

[22] Filed: Dec. 28, 1992

[51] Int. Cl.[5] ..... G08G 1/00

[52] U.S. Cl. ..... 246/3; 246/122 R; 364/453; 342/456

[58] Field of Search ..... 246/122 R, 62, 63 R, 246/63 C, 63 A, 28 F, 107; 364/424.1, 436, 447, 449, 453, 454; 342/451, 464, 463, 457, 456, 454

[56] References Cited

U.S. PATENT DOCUMENTS

| | | | |
|---|---|---|---|
| 3,702,427 | 11/1972 | Brown | 364/453 |
| 3,739,383 | 6/1973 | Perot et al. | 364/453 |
| 3,757,112 | 9/1973 | Lehmann | 246/122 R |
| 3,888,437 | 6/1975 | Birkin | 246/122 R |
| 4,027,840 | 6/1977 | Blair | 246/122 R |
| 4,028,531 | 6/1977 | Cottin et al. | 246/122 R |
| 4,106,094 | 8/1978 | Land | 364/447 |
| 4,556,940 | 12/1985 | Katoo et al. | 364/424.1 |
| 4,713,767 | 12/1987 | Sato et al. | 364/453 |
| 4,768,740 | 9/1988 | Corrie | 246/122 R |
| 4,864,306 | 9/1989 | Wiita | 246/122 R |
| 4,899,285 | 2/1990 | Nakayama et al. | 364/453 |
| 5,012,424 | 4/1991 | Dodson | 364/449 |
| 5,067,083 | 11/1991 | Nakayama et al. | 364/453 |
| 5,177,685 | 1/1993 | Davis et al. | 364/443 |
| 5,184,304 | 2/1993 | Huddle | 364/453 |

FOREIGN PATENT DOCUMENTS

| | | | |
|---|---|---|---|
| 2222266 | 12/1978 | Fed. Rep. of Germany | 246/122 R |
| 2124089 | 4/1979 | Fed. Rep. of Germany | 246/122 R |

*Primary Examiner*—Mark T. Le
*Attorney, Agent, or Firm*—Buchanan Ingersoll

[57] ABSTRACT

A railway traffic control system in which accurate vehicle information is effectively available in real-time to facilitate control of traffic flow. Unlike prior art methods of precisely monitoring train location, the current invention is dependant only on equipment on-board the vehicle and position updates provided by external benchmarks located along the track route. The system's dynamic motion capabilities can also be used to sense and store track rail signatures, as a function of rail distance, which can be routinely analyzed to assist in determining rail and road-bed conditions for preventative maintenance purposes. In presently preferred embodiments, the on-board vehicle information detection equipment comprises an inertial measurement unit providing dynamic vehicle motion information to a position processor. Depending on the amount and quality of apriori knowledge of the vehicle route, the inertial measurement unit may have as many as three gyroscopes and three accelerometers or as little as a single accelerometer. To minimize error between benchmarks, the processor preferably includes a recursire estimation filter to combine the apriori route information with movement attributes derived from the inertial measurement unit.

53 Claims, 5 Drawing Sheets

TRAFFIC CONTROL SYSTEM UTILIZING ON-BOARD VEHICLE INFORMATION MEASUREMENT APPARATUS

BACKGROUND OF THE INVENTION

1. Field of the Invention

The invention relates generally to the art of railway signaling and communication. More particularly, the invention relates to the use of a dynamic vehicle operating characteristic measurement and control system effectively operative in real-time to optimize scheduling and flow of vehicle traffic.

2. Description of the Prior Art

Vehicle traffic control systems for railway and transit installations interconnect the central train control ("CTC") facility to wayside equipment such as switch and signal devices. To prevent the establishment of conflicting routes and to optimize scheduling based on the available equipment, such systems incorporate means to detect the presence of vehicles within the controlled territory. Typically, this train detection capability has been provided by the railway track circuit. The railway track circuit basically detects the presence of a railway vehicle by electrical alteration of a circuit formed by the rails and the vehicle wheel and axle sets. While there are many variations, railway track circuits are generally connected within fixed-location, fixed-length sections of track route known as blocks. Blocks may range in length from hundreds of feet to a maximum of approximately two to five miles. While these systems can positively detect the presence of a railway vehicle within the particular block, it cannot be particularly located therein. Thus, location resolution of such track circuits is generally defined by the length of the block.

Alternative train operation systems have been proposed which require more accurate train detection than may be provided by present track circuits. Specifically, the promulgation of the Advanced Train Control System ("ATCS"), the introduction of high speed train technology, and the need to optimize scheduling and energy utilization have established a requirement to measure the position of a railway vehicle effectively in real-time and on the order of one meter. It is also desirable to have real-time information concerning motion and grade status of the individual vehicles.

Currently, to provide accurate vehicle information such as position, motion and attitude in effective real-time for a land transportation application having a widely-varied dynamic environment requires reliance on satellite tracking systems such as the global position system, dead-reckoning systems, or installation of wayside mounted sensing systems. These systems may not be able to provide such information in mountainous terrain, tunnels or other geographical regions which inhibit their effective operation.

SUMMARY OF THE INVENTION

The invention provides a railway traffic control system in which dynamic vehicle operating characteristics are accurately available in effective real-time to facilitate control of traffic flow. These dynamic vehicle operating characteristics are obtained utilizing inertial equipment on-board the vehicle augmented by stored apriori route data or position updates provided by external benchmarks located along the track route. Preferably, a master-follower processor arrangement is provided to support vitality of the inertial measurement system. The system's dynamic motion capabilities canal so be used to sense and store track rail signatures, as a function of rail distance, which can be routinely analyzed to assist in determining rail and road-bed conditions for preventative maintenance purposes.

In presently preferred embodiments, the on-board vehicle information detection equipment comprises an inertial measurement unit providing inertial variable information to a position processor. Depending on the amount and quality of apriori knowledge of the vehicle route, the inertial measurement unit may have as many as three gyroscopes and three accelerometers or as little as a single accelerometer. To minimize error between benchmarks, the processor preferably includes a recursire estimation filter to compare and update movement attributes derived from the inertial variable information supplied by the inertial measurement unit with the apriori route information. In presently preferred embodiments, the recursire estimation filter is implemented as a Kalman filter. Accuracy can be further increased by providing additional augmenting signals such as velocity measurements.

DETAILED DESCRIPTION OF PRESENTLY PREFERRED EMBODIMENTS

Figure 1:
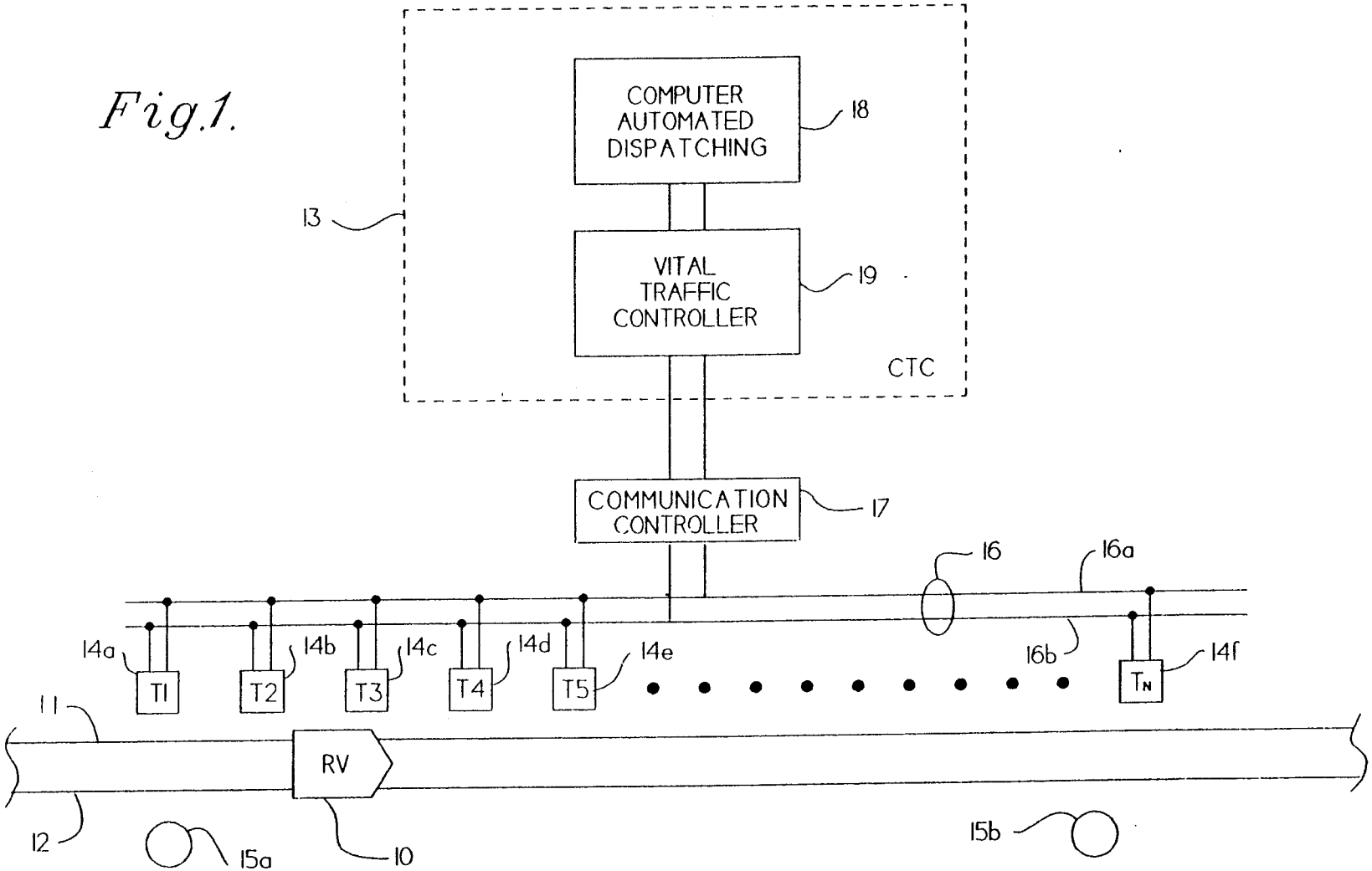
FIG. 1 is a diagrammatic representation of railway territory equipped according to an embodiment of the invention to communicate vehicle information and control signals with a passing railway vehicle.

FIG. 1 illustrates a portion of railway territory controlled according to the teachings of the present invention. A railway vehicle ("RV") 10 is traveling as shown along a track route defined by rails 11 and 12. Communication links between vehicle 10 and central train control ("CTC") facility 13 is preferably provided by a series of transceivers ("T1, T2, T3, T4, T5, . . . , $T_N$") 14*a–f* mounted at selected locations along the track route in relatively close proximity. Although transceivers 14*a–f* are illustrated beside the track route, in practice they may be located in the area between rails 11 and 12.

Transceivers 14*a–f* are capable of storing compressed binary information, such as the physical track location of the respective transceiver, which can generally be read by vehicle 10 with less than one millisecond of time latency. Additionally, each transceiver may accept information transfers from vehicle 10 as it passes. This information may also be in the form of a compressed binary state vector containing dynamic vehicle information such as position, acceleration, velocity, or attitude which are determined on-board vehicle 10. As will be explained more fully herein with respect to FIGS. 3 through 4, the accuracy of such determination may be enhanced in some applications utilizing a series of benchmark transponders 15*a–b* selectively located along the track route.

Transceivers 14*a–f* may be interconnected utilizing a high-speed data bus which provides an autonomous elementary fixed block signaling system. Local intelligence can thus be provided at selected transponder locations to support traditional visible signal operations. The high-speed data bus preferably comprises a dual fiber optic wide area network ("WAN") 16. WAN 16 includes first and second fiber optic buses 16*a* and 16*b* which respectively provide communication to and from communication controller 17. Controller 17 in turn manages data flow to and from CTC facility 13. CTC facility 13 preferably includes a computer aided dispatcher ("CAD") 18 which utilizes vehicle information, typically vehicle position, obtained from transceivers 14*a–f* to optimize traffic scheduling and headway between vehicles. CAD 18 may also calculate a braking strategy that can be transmitted to vehicle 10 to, when activated, optimize energy usage.

Preferably, CTC facility 13 and controller 17 are constructed to operative standards referred to as "vital." In the art, the term vital means that a failure in the system will correspond to a restrictive condition of vehicle operation. A voting strategy is very desirable to support the analytical demonstration that the standards associated with a vital system have been satisfied. CTC facility 13 may therefore be made vital by the implementation of a voting front end traffic controller 19 to "CAD" 18. Controller 17 may likewise be constructed to incorporate such a voter. A typical track circuit system may also be provided as an additional backup to further support vitality.

Figure 2A:
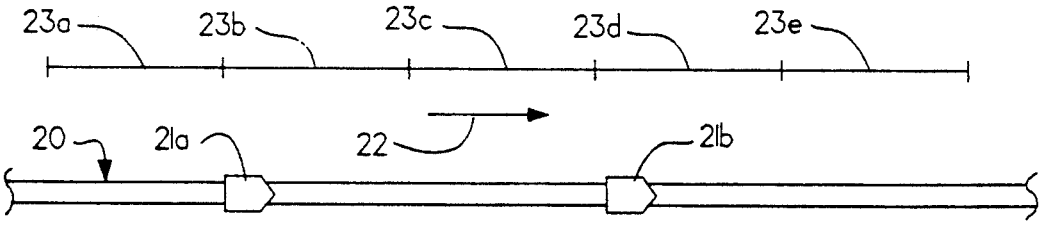
Fig.2A. Prior Art
FIGS. 2A and 2B are diagrammatic representations of a section of a track route respectively controlled according to a prior art block signalling scheme and a minimal headway scheme achievable with the present invention.
Figure 2B:
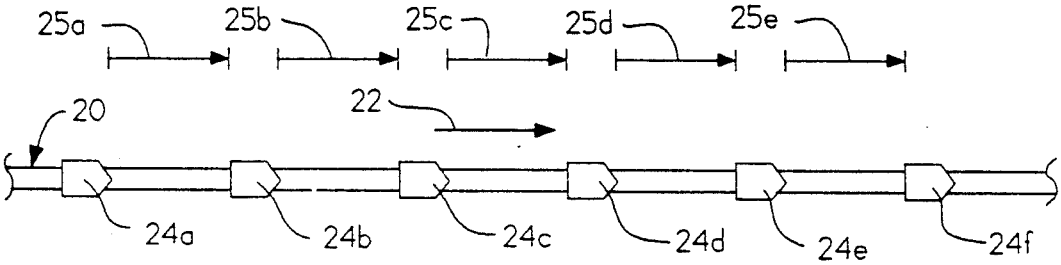

The operational advantages attainable with the invention may be best understood with reference to FIGS. 2A and 2B. Referring particularly to FIG. 2A, a section 20 of a track route is illustrated as controlled according to a traditional block signalling scheme. Section 20 is divided into a number of discrete blocks shown adjacent 23*a–e*. The fixed length of the blocks is typically based on the stopping distance of a railway vehicle traveling along block 20 at the maximum allowable operating speed. Generally, the scheme permits only one vehicle to occupy a block at any particular time. Also, adjacent vehicles travelling unrestricted are generally spaced by an unoccupied block. Thus, a vehicle making an immediate stop would generally have adequate stopping distance. For example, consider railway vehicles 21*a* and 21*b* which are illustrated traversing section 20 in the direction of arrow 22. Railway vehicle 21*a* occupies the block adjacent 23*b*. Instead of occupying the block adjacent 23*c*, however, railway vehicle 21*b* occupies the block adjacent 23*d*.

FIG. 2B illustrates improved traffic flow using a moving block system.. As can be seen, this scheme permits section 20 to be populated by a plurality of railway vehicles 24*a–f*. Vehicles 24*a–f* are separated by respective headway distances (shown adjacent 25*a–e*) calculated to permit stoppage if required. Since these headway distances, or "moving blocks," travel along with the flow of traffic, the need to separate adjacent vehicles by predetermined fixed lengths of unoccupied block is eliminated.

A significant foundation of the moving block virtual system of the invention is thus the capability of individual railway vehicles to collect information on their current operating characteristics. Such information is preferably derived by an inertial measuring system updated by benchmarks selectively located along the track route. Such a system, which will now be explained, provides desired position accuracy with high reliability and at relatively low cost.

Autonomous inertial navigation systems typically contain inertial measurement sensors which describe vehicle motion in three dimensions. Specifically, these navigation systems generally incorporate three linear accelerometers and three gyroscopes. A computer then interprets the accelerometer and gyroscope outputs to navigate the vehicle. If a vehicle operates over a known route, such as a railroad track, the navigation system can use apriori route information to reduce the navigation process to a single dimension, i.e., distance traveled along the route. Furthermore, if survey data of the route is stored in the system processor, advantage can be taken of this stored apriori knowledge to increase the accuracy, or reduce the number the of, inertial measurement sensors.

Figure 3:
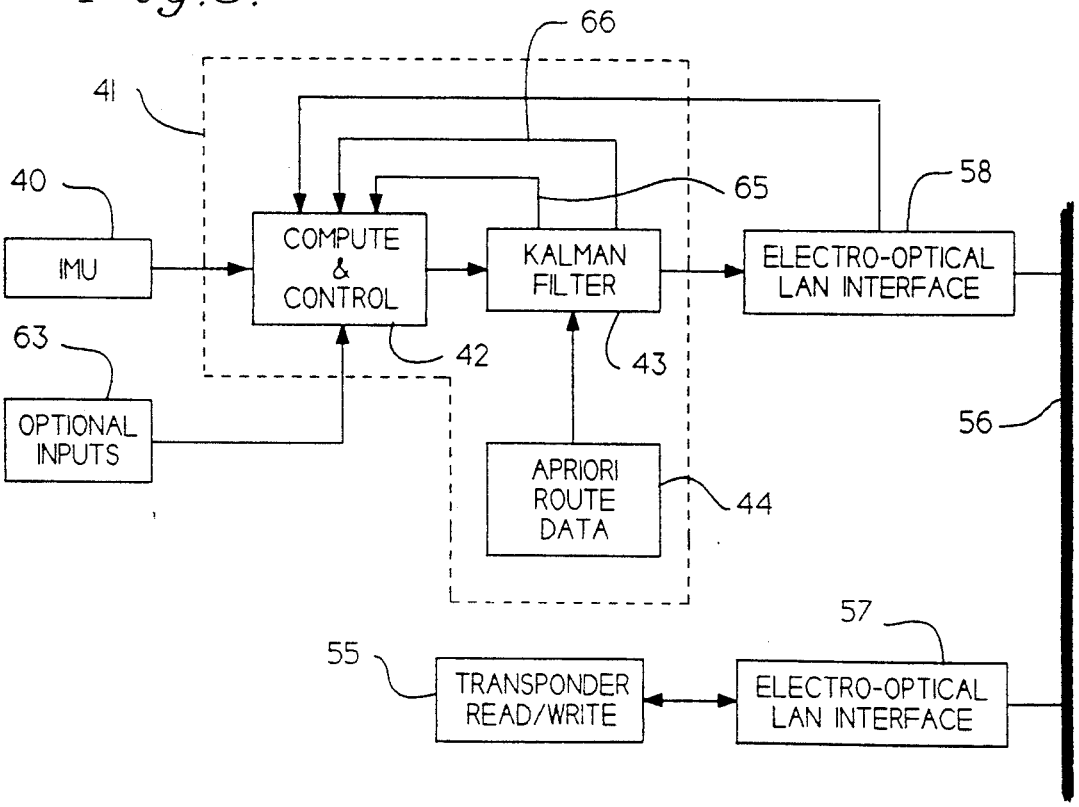
FIG. 3 is a block diagram illustrating vehicle information measurement equipment carried on-board a railway vehicle.

FIG. 3 diagrammatically illustrates equipment carried on-board the railway vehicle for measuring the desired vehicle. information. An inertial measurement unit ("IMU") 40 supplies dynamic vehicle motion information necessary, based on the apriori track route data, to determine the position and other vehicle information. IMU 40 is preferably a strapdown inertial measurement in which the inertial instruments are mounted to a common base. Recent advances in micromachine inertial measurement instruments may provide useful realizations of IMU 40 in some applications. The output of IMU 40 is fed to processor 41, which obtains the desired dynamic vehicles characteristics to the requisite degree of accuracy. In presently preferred embodiments, processor 41 functionally includes computation and control module 42, Kalman filter 43 and apriori route data memory 44.

Figure 3A:
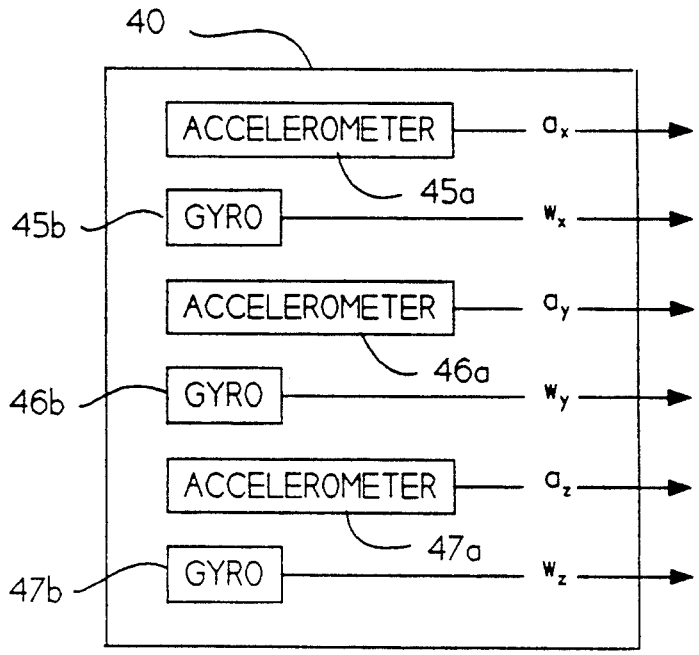
FIG. 3A is a block diagram illustrating an inertial measurement unit usable with some embodiments of the invention.

Referring to FIG. 3A, IMU 40 includes inertial measurement devices operative to detect dynamic deviations with up to six degrees of freedom. Specifically, depending on the nature and quality of apriori route information, IMU 40 may have up to three acclerometers 45*a*, 46*a*, and 47*a* and three gyroscopes 45*b*, 46*b*, and 47*b*. Accelerometer 45*a* and gyroscope 45*b* respectively measure acceleration along and angular movement around a first axis X fixed with respect to the vehicle. Similarly, accelerometer 46*a* and gyroscope 46*b* measure deviations associated with a second axis Y situated at a right angle to axis X. Deviations associated with a third axis Z orthogonal to both axes X and Y are likewise measured by accelerometer 47*a* and gyroscope 47*b*. These six inertial variables may be respectively designated: $a_X$, $\omega_X$, $a_Y$, $\omega_Y$, $a_Z$, $\omega_Z$.

With complete survey data, the inertial measurement sensors within IMU 40 can be reduced to a single accelerometer. With less complete survey information, additional inertial instruments can be used to supply the supplement the lack of apriori route information. Some of the additional instruments may be utilized even when complete apriori route information is available to provide a degree of redundancy. For example, some applications may utilize two accelerometers and two gyroscopes. In other applications, it may be desirable to use a single accelerometer and a single gyroscope.

Module 42 receives vehicle acceleration and angular rate vectors sensed by IMU 40 and derives certain vehicle movement attributes based on well-known mathematical formulae. The movement attributes will depend on the requirements of the particular application, but may typically include distance traveled (arc length) from the last benchmark, speed, cross-axis (perpendicular-to route) speed, azimuth, and vitality information. The information produced by module 42 is then passed to Kalman filter 43 to produce the desired dynamic operating characteristics for vehicle control.

A Kalman filter is formulated using the state-space approach, in which a dynamic system is represented by a set of variables collectively called the "state." If the past and present input values of the system are known, the state contains all information necessary to compute the .present output and state. Since the need to store entire past observed data is eliminated, the Kalman filtering algorithm is considered computationally efficient. Concepts and operating principles of a Kalman filter are discussed in the following work: Simon Haykin, *Adaptive Filter Theory* (1986), published by Prentice-Hall of Englewood Cliffs, N.J.

Kalman filter 43 combines data produced by module 42 with apriori route data within memory 44 and augmenting signals to increase measurement accuracy by orders of magnitude over that obtainable with autonomous systems. Such augmenting signals may include velocity measurements and occasional position updates supplied to the vehicle. In the event that one or more inertial instruments are contained within IMU 40 than are specifically required for the available apriori route information, they may also be retained as additional state measurements for input to the Kalman filter.

In presently preferred embodiments, the position updates are obtained by a transponder read/write device 55 which detects the presence of the benchmarks permanently located along the route. Device 55 reads data stored in the benchmark such as benchmark number, route identification, distance along the route, longitude, latitude and the like. This information is then communicated to processor 41 over a appropriate communication channel, such as high-performance LAN 56. LAN 56 may be a redundant optical fiber LAN interfaced between the electrical systems by electro-optical LAN interfaces 57 and 58.

Figure 4:
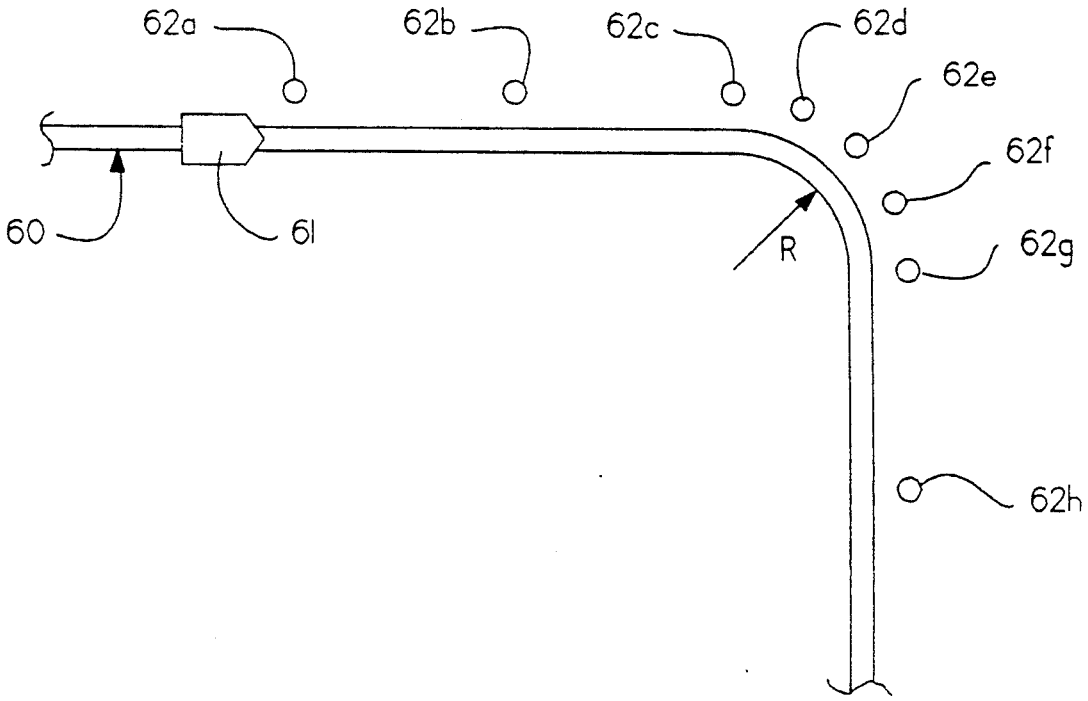
FIG. 4 is a diagrammatic representation of a section of track route equipped with benchmarks spaced apart at selected locations to provide information updates to the on-board vehicle information measurement equipment.

FIG. 4 illustrates a route section 60 being traversed by a railway vehicle 60 and having a plurality of benchmarks 62*a–h* displaced at selected locations. For best accuracy, the positioning of benchmarks 62*a–h* should be surveyed with particularity. Because it may be desirable to determine dynamic operating characteristics of vehicle 60 for reasons other than control of traffic flow, the vehicle information measuring system of the invention may be used as a part of, or separate from, the moving block system described above.

Over straight regions of route section 60, very infrequent survey data may be required by Kalman filter 43. Thus, for example, benchmarks 62*a* and 62*b* may be spaced many kilometers apart. Over portions of the route where turns, banks or grade is rapidly changing, the quality and frequency of survey data must be adequate to support the overall required position accuracy. Thus, where route section 60 bends (shown having a bend radius R), benchmarks 62*c–g* may be placed closer than a few kilometers apart.

Referring again to FIG. 3, velocity measurements for use by Kalman filter 43 are illustrated as being among optional inputs 63 into module 42. These measurements can be made by any one of a number of velocity measuring devices, such as a Doppler-based system (acoustic or electromagnetic), or a correlation function of video or pulse detectors. Typically, however, velocity information may be provided by the vehicle wheel tachometer. Alternatively, the use of a pair of transponders installed at close proximity along the route can provide a means of obtaining a precision velocity update in addition to or in supersession of that provided by the tachometer. Use of such dual transponders in addition to the vehicle tachometer provides a redundant speed measuring system to further support vitality.

As stated above, Kalman filter 43 updates the navigation information produced by module 42 from the measurements of IMU 40 with the benchmark data, velocity and other optional inputs, and apriori route information. By combining these signals, Kalman filter 43 recursively produces a minimum mean square estimate of the desired vehicle dynamic operating. The one sigma position error becomes the desired magnitude in steady state.

The apriori route information is preferably stored in parameterized form as a function of distance. For example, such information may include the following data:

$$L=L(s),\ \Lambda=\Lambda(s),\ A=A(s),\ \theta=\theta(s),\ \Phi=\Phi(s),\ \Psi=\Psi(s)$$

where:

L=Latitude, $\Lambda$=longitude, h=elevation, $\Psi$=route heading or yaw angle, A=azimuth, s=distance, $\theta$=route grade or pitch angle, $\Phi$=route bank or roll angle The route angles $\theta$, $\Phi$, and $\Psi$ are measured relative to the local level reference frame. Use is made of the following equations to derive the equivalent rate gyro signals (which are optionally not used):

$$\dot{s} = \text{velocity} = \frac{ds}{dt}$$

$$\dot{\phi} = s\frac{\partial\phi(s)}{\partial s}$$

$$\dot{\theta} = \dot{s}\frac{\partial\theta(s)}{\partial s}$$

$$\dot{\Psi} = \dot{s}\frac{\partial\Psi(s)}{\partial s}$$

The computational frame of the train information measuring system may be defined as a right-handed coordinate frame (x, y, z), where x is in the plane of the route along the track at an angle A from north, y is in the plane of the route and perpendicular to x, and z is the vector product orthogonal to the x and y axes. When the angular rates $\dot{\theta}$, $\dot{\Phi}$ and $\dot{\Psi}$ are transformed into this coordinate frame and combined with the angular rates of the local level frame relative to the earth (these rates are caused by the vehicle movement over the earth's surface) and the angular rate of the earth's rotation relative to inertial space, the three equivalent rate gyro signals $\omega_X$, $\omega_Y$, and $\omega_Z$ are formed. These calculated signals can be used to replace the rate gyros.

Since the vehicle is traveling over a known route, the average cross-route velocity, $v_y$, deviates from zero only as permitted by the vehicle suspension system and a small component caused by the route bank angle coupled with the actual location of the equipment in the vehicle. Over any short interval, this will average to zero. This apriori information can be used to eliminate the accelerometer measuring acceleration along the y axis. The main function of the accelerometer which measures z axis acceleration is to calculate deviations in height about the earth geoid. This deviation is determined from apriori elevation parameter h.

The apriori route information can thus be used to eliminate up to three gyros and two accelerometers. As a result, the system is reduced to operating in the desired single dimension of distance travelled along the route. This distance can be accurately updated with the passage of each benchmark. Long term use of the vehicle information measuring system will provide a data bank of vehicle position history that will allow further refining of the apriori information stored in memory 44. As a result, accuracy of position determinations for all trains operating on the specific route can be enhanced.

The output of Kalman filter 43 can include, depending on the particular application, any number of various dynamic information relating to the vehicle. For example, such vehicle include geographic coordinates, vehicle position and speed, odometer reading, distance to destination and way points, time of day and time of arrival, along-track acceleration, cross-track acceleration (which is useful in determining excessive speed on turns or degraded road beds), and vitality data. In addition to being communicated to the CTC facility, this information can be directly displayed to the vehicle operator. In fact, the system disclosed herein is not limited to use in railway vehicles, but is applicable to any surface vehicle traveling known routes. Thus, the term "vehicle" as used herein should thus be constructed to include vehicles operating on roadways or guideways generally.

Kalman filter 43 also estimates major error sources in the sensors of IMU 40 which contribute to output errors from module 42. Kalman filter 43 uses this information to periodically reset module 42, via reset line 65, to keep it operating in the linear region. Kalman filter 43 also indicates via line 66 any errors in the state vector which exceed preselected limits. Module 42 is thus able to augment the determination of the vital status of the overall system.

Figure 5:
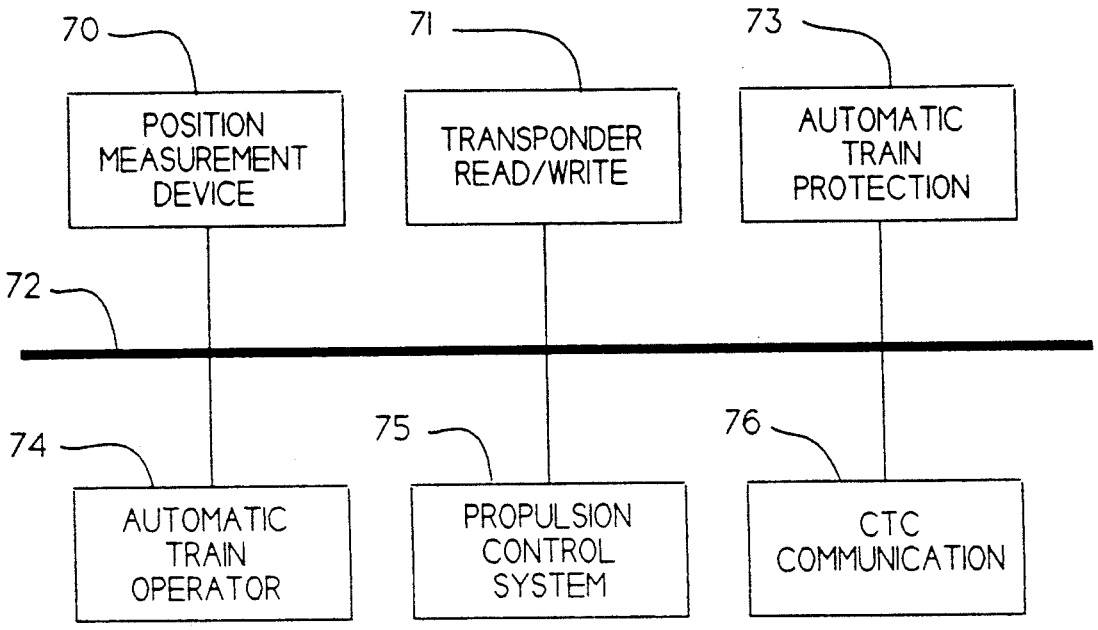
FIG. 5 is a block diagram of a car-borne communication and control system incorporating the on-board vehicle information measurement equipment.

As illustrated in FIG. 5, the vehicle information measuring system can be integrated as part of an overall carborne control and automation system. Specifically, a position measurement device 70 incorporating IMU 40 and associated processor 41 may be linked to transponder read/write module 71 along with various other components via LAN 72. These other components may include automatic train protection system 73, automatic train operator 74, propulsion control system 75 and a communication system 76 providing communication to the CTC facility computer system such as via transceivers 14*a–f* of FIG. 1.

Track conditions and a planned program of preventative maintenance are major concerns of railway maintenance efforts in order to increase vehicle stability, optimum scheduling of vehicle traffic, and the minimization of energy. The system's dynamic movement measurement capabilities also can be used to sense and store track rail signatures, as a function of rail distance that can be routinely analyzed to assist in determining rail and road bed conditions for such preventative maintenance purposes.

In the United States, the diagnostic condition of railroad track is generally ranked in six classes ranging from the best condition of a class six (6) down toga class one (1). A geometric standard and a maximum operating speed is specified for each of these classes. The geometric standard requires the track geometry to be within tolerable limits as defined for the particular class. Track geometry is defined by four track profiles as follows: surface, cross level, alignment and gauge. Each measures the departure of the actual track position from its nominal position in one of four independent directions. Surface is the elevation of the track center line with respect to its nominal position, whereas alignment is its lateral displacement. Cross-level is the difference in elevation between the two opposing rails and gauge is the distance between them.

A level track is defined as two mathematically straight and parallel rails on a rigid horizontal surface. In practice, this ideal model can only be approximated because rails do deviate from the straight line assumption. Consider a single "almost straight" rail section resting on a horizontal surface. This rail section may deviate from the straight line in two independent directions, i.e., vertically and laterally. At any given point "x" along the length of the rail, the vertical displacement is z(x) and the lateral displacement is y(x).

Similarly, a pair of "almost parallel," "almost straight" rails can deviate from perfection in four ways. Displacement in the left rail can be denoted as $z_l(x)$ and $y_l(x)$. Displacement of the right rail can similarly be characterized by $z_r(x)$ and $y_r(x)$. Any track condition can be expressed in these four functions, which are thus defined as follows:

| | |
|---|---|
| Surface | $S(x) = (z_r + z_l)/2;$ |
| Cross Level | $C(x) = z_r - z_l;$ |
| Alignment | $A(x) = (y_r + y_l)/2;$ |
| Gauge Deviation | $G(x) = y_r - y_l.$ |

These basic functions and their associated superpositions describe the signature of a track as a function of position.

Figure 6:
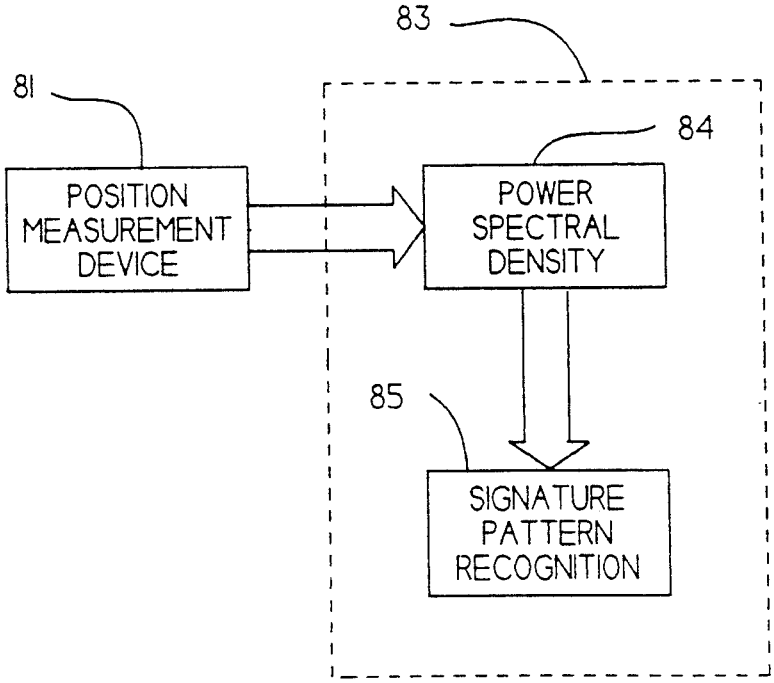
FIG. 6 is a block diagram illustrating a track measurement device utilizing train information measured according to the invention to generate a real-time track quality metric.

Although methods are available with various electronic and mechanical means to measure these rail functions, the data is difficult to obtain, costly to process and generally is not available in real-time to support operations maintenance efforts. Instead, the track condition data requires lengthy analysis and study before maintenance action is taken. The implementation of an onboard vehicle information measuring system provides data in real-time that can be processed to develop the signature of a track descriptive of the current track conditions. An expert system at the CTC facility can compare the real-time signatures with standard signatures and provide a plan for preventative maintenance. The apparatus utilized in presently preferred embodiments to provide this real time signature is illustrated in FIG. 6.

Position measurement device 81 outputs data describing the dynamic operating characteristics of the vehicle in six degrees of freedom. Specifically, data describing vehicle position, motion and attitude are fed to dynamic track analyzer 83. In presently preferred embodiments, track analyzer includes an waveform analyzer 84 and a signature pattern recognition network 85. It should be understood that, although device 81 and analyzer 83 are shown as being directly connected, such would not normally be the case. Generally, analyzer 83 would be located at the CTC facility which is in communication with the on-board equipment as described above.

In presently preferred embodiments, waveform analyzer 84 is a power spectral density ("PSD") analyzer which develops a power spectral density signature pattern. Network 85, which is preferably a neural network, receives the pattern of analyzer 84 and gives an enhanced track metric taking the following generalized form:

| | |
|---|---|
| Surface | $S(x,n) = F[(z_r + z_l), PSD]$; |
| Cross Level | $C(x,n) = F[(z_r - z_l), PSD]$; |
| Alignment | $A(x,n) = F[(y_r + y_l)/2, PSD]$; |
| Gauge Deviation | $G(x,n) = F[(y_r - y_l), PSD]$. |

where n is a discrete interval of time. In addition to providing real-time information for preventive maintenance planning, the CTC facility can use this data to calculate vehicle rolling resistance. This information can be coordinated with acceleration and a calculated braking strategy for the vehicle to optimize fuel usage.

Figure 7:
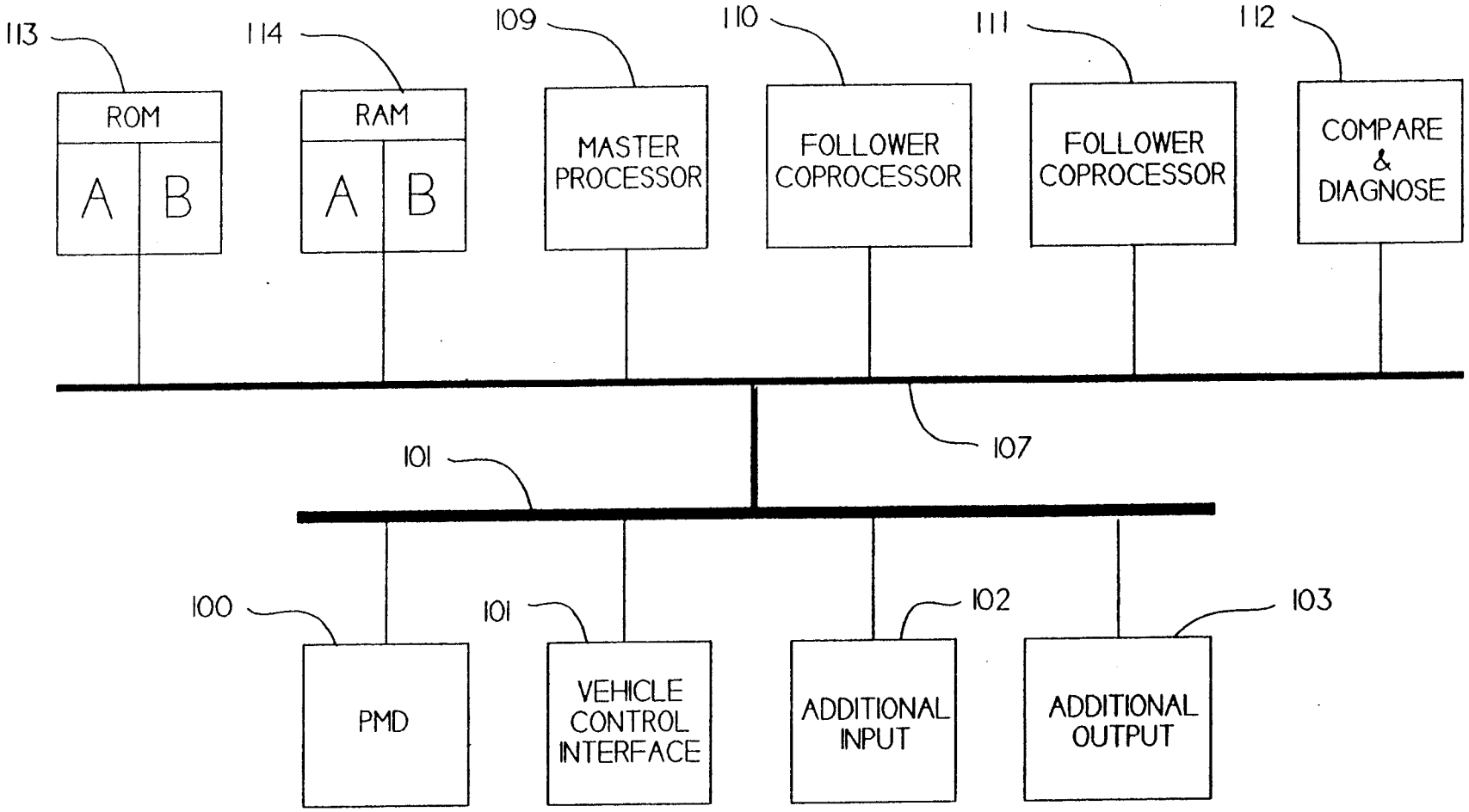
FIG. 7 is a block diagram illustrating a simplex virtual voting architecture utilized according an embodiment of the invention to enhance system vitality.

FIG. 7 illustrates a simplex architecture which may be utilized to support vitality in the vehicle information collection system or wayside controllers. A simplex architecture generally provides a cost effective approach to process logic equations and/or position, motion and other real-time data. It has been demonstrated by prior art, however, that a simplex controller must be enhanced to meet robust standards for vitality. Also, the simplex enhancements must-yield an analytical proof-of-correctness to demonstrate that vital standards have been satisfied.

Since a simplex architecture is a single processor, a virtual voting strategy has been implemented as a simplex controller environment with the aid of two coprocessors that are associated with the simplex processor device in a master-follower architecture. The vital coprocessors may be relatively low-cost. application specific integrated circuit ("ASIC") devices. In addition, such coprocessors satisfy the need for independent devices to implement a virtual voting strategy.

Referring now particularly to FIG. 7, a simplex architecture which may be utilized on-board the vehicle is illustrated. Position measurement device ("PMD") 100 is interconnected via input/output ("I/O") bus 101 with vehicle control interface 102 may supply logic concerning various other conditions on the vehicle (such as whether a door is open or shut) which may affect the decision to stop or proceed. Additional input and output which may desirable in particular applications can be provided at 103 and 104. respectively.

Various components of the vital simplex controller are interconnected via processor bus 107 which is tapped to I/O bus 101. The controller samples the discrete input and measurement data at the beginning of each processing cycle. Master processor 109 manages calculation of the output vector to be released at the end of each cycle. Before the output vector can be released, however, certain vital voting tests must be satisfied. Specifically, master processor 109 invokes first follower coprocessor 110 to calculate an instruction and address check sum after execution of each instruction or block of instructions. In In addition, second follower coprocessor 111 takes the output vector calculated by master processor 109 during the cycle interval and, with the aid of an inverse calculation algorithm, calculates the input vector which caused the particular output vector result.

Once the validations have been completed by coprocessors 110 and 111, a number of other tests are performed before the output vector is released. Specifically, the address and instruction check sum calculated by follower coprocessor 110 is compared by comparator 112 with a precalculated address and check sum stored by read only memory ("ROM") 113. In addition, the input vector calculated by the reverse algorithm is compared with the input vector sampled at the start of the cycle (which has been temporarily stored in random access memory ("RAM") 114). As shown, ROM 113 and RAM 114 may be divided into redundant areas "A" and "B" to further support vitality. These areas may be used, for example, to respectively store the desired data and its complement. Before use of the data, comparator 112 may perform a checking function to diagnose its accuracy. If all of the comparisons are satisfied as true, the output vector is released. Otherwise, the controller has failed and the output will not be released.

While presently preferred embodiments of the invention and presently preferred methods of practicing the same have been shown and described, it is to be distinctly understood that the invention is not limited thereto but may be otherwise embodied and practiced within the scope of the following claims.

We claim:

1. A railway traffic control system for facilitating traffic flow of a plurality of railway vehicles travelling a predetermined track route, said system comprising:

an inertial measurement apparatus carried on-board each respective vehicle of said plurality of railway vehicles;

said inertial measurement apparatus including at least one inertial measurement sensor for detecting a corresponding inertial variable;

said inertial measurement apparatus further including processing means for deriving a current position estimate of said respective vehicle based on said inertial variable detected by said at least one inertial measurement sensor;

vehicle control means for determining a desired traffic flow of said plurality of railway vehicles based on respective current position estimates of said vehicles; and communication means for communicating respective current position estimates from each of said plurality of railway vehicles to said control means.

2. The railway vehicle control system of claim 1 wherein said communication means further provides communication of operational instruction data to said plurality of railway vehicles to effect a virtual moving block scheme of traffic flow along said predetermined track route.

3. The railway vehicle traffic control system of claim 1 wherein said processing means further includes:

memory means for storing apriori route information of said predetermined track route; and comparator means for comparing said current vehicle position estimate with said apriori route information and update said current vehicle position estimate based on such comparison.

4. The railway vehicle traffic control system of claim 3 wherein said comparator means includes a recursive estimation filter.

5. The railway vehicle traffic control system of claim 4 wherein said recursive estimation filter is a Kalman filter.

6. The railway vehicle traffic control system of claim 1 wherein said communication means includes a multiplicity of interconnected communication devices placed at selected locations along said predetermined track route.

7. The railway vehicle traffic control system of claim 1 further comprising:

benchmark means at fixed locations along said predetermined track route for selectively communicating benchmark position information to said plurality of railway vehicles when said respective vehicles are in proximity to said benchmark means; and said processing means further including comparator means for comparing said current vehicle position estimate with said benchmark position information and updating said current vehicle position estimate based on such comparison.

8. The railway vehicle traffic control system of claim 7 wherein said comparator means includes a recursive estimation filter.

9. The railway vehicle traffic control system of claim 8 wherein said recursive estimation filter is a Kalman filter.

10. The railway vehicle traffic control system of claim 7 wherein said benchmark means comprises a plurality of benchmark transponders placed at selected fixed locations along said predetermined track route.

11. The railway vehicle traffic control system of claim 7 wherein said processing means further includes memory means for storing apriori route information of said predetermined route, said comparator means further operative to periodically compare said current vehicle position estimate with said apriori route information and update said current vehicle position estimate based thereon.

12. The railway vehicle control system of claim 1 wherein said processing means further determines vehicle motion and grade information based on said at least one inertial variable from said inertial measurement means.

13. The railway vehicle traffic .control system of claim 12 wherein said vehicle control means further determines a track metric as a function of position and time based said current position estimate and said vehicle motion and grade information, said track metric indicative of a diagnostic condition of said predetermined track route.

14. The railway vehicle traffic control system of claim 11 wherein said comparator means includes a recursive estimation filter.

15. The railway vehicle traffic control system of claim 14 wherein said recursive estimation filter is a Kalman filter.

16. A vehicle traffic control system for facilitating traffic flow of a plurality of land vehicles travelling a predetermined route, said system comprising:

an inertial measurement apparatus carried on-board each respective vehicle of said plurality of land-based vehicles;

said inertial measurement apparatus including a least one inertial measurement sensor for detecting a corresponding inertial variable;

said inertial measurement apparatus further including' processing means for deriving a current estimate of at least one dynamic vehicle operation characteristic of said respective vehicle based on said inertial variable detected by said at least one inertial measurement sensor;

said processing means including memory means for storing apriori route information of said predetermined route; and comparator means operative to periodically compare said current estimate of said at least one dynamic vehicle operation characteristic with said apriori route information and update said current estimate based on such comparison; and vehicle control means for determining a desired traffic flow pattern along said predetermined route based on respective current position estimates of said plurality of land vehicles.

17. The vehicle traffic control system of claim 16 further comprising:

communication means for communicating respective vehicle position estimates from each of said plurality of land vehicles to said control means.

18. The vehicle traffic control system of claim 17 wherein said communication means includes a multiplicity of interconnected communication devices placed at selected locations along said predetermined route.

19. The vehicle traffic control system of claim 18 wherein said comparator means includes a recursive estimation filter.

20. The vehicle traffic control system of claim 19 wherein said recursive estimation filter is a Kalman filter.

21. The vehicle traffic control system of claim 17 further comprising:

benchmark means at fixed locations along said predetermined route for selectively communicating benchmark position information to said plurality of land vehicles when said respective vehicles are in proximity to said benchmark means;

said processing means further including comparator means for comparing said current estimate of said at least one dynamic vehicle operating characteristic with said benchmark position information and updating said current vehicle position estimate based on an output of said comparator means.

22. The vehicle traffic control system of claim 21 wherein said benchmark means comprises a plurality of benchmark transponders placed at selected fixed locations along said predetermined route.

23. The vehicle traffic control system of claim 21 wherein said comparator means includes a recursive estimation filter.

24. The vehicle traffic control system of claim 23 wherein said recursive estimation filter is a Kalman filter.

25. The vehicle traffic control system of claim 17 wherein said current estimate of said at least one dynamic vehicle operating characteristic includes a current position estimate of said respective vehicle.

26. A vehicle traffic control system for facilitating traffic flow of a plurality of land vehicles travelling a predetermined route, said system comprising:

an inertial measurement apparatus carried on-board each respective vehicle of said plurality of land-based vehicles;

said inertial measurement apparatus including a least one inertial measurement sensor for detecting a corresponding inertial variable;

said inertial measurement apparatus further including processing means for-deriving a current estimate of at least one dynamic vehicle operation characteristic of said respective vehicle based on said inertial variable detected by said at least one inertial measurement sensor;

benchmark means at fixed locations along said predetermined route for selectively communicating benchmark position information to said plurality of land vehicles when said. respective vehicles are in proximity to said benchmark means;

said processing means further including comparator means for comparing said current estimate of said at least one dynamic vehicle operating characteristic with said benchmark position information and updating said current vehicle position estimate based on such comparison; and vehicle control means for determining a desired traffic flow pattern along said predetermined route based on respective current position estimates of said plurality of land vehicles.

27. The vehicle traffic control system of claim 26 wherein said communication means includes a multiplicity of interconnected communication devices placed at selected locations along said predetermined route.

28. The vehicle traffic control system of claim 26 wherein said comparator means includes a recursive estimation filter.

29. The vehicle traffic control system of claim 28 wherein said recursive estimation filter is a Kalman filter.

30. The vehicle traffic control system of claim 26 wherein said benchmark means comprises a plurality of benchmark transponders placed at selected fixed locations along said predetermined route.

31. The vehicle traffic control system of claim 26 wherein said processing means further comprises memory means for storing apriori route information of said predetermined route, said comparator means operative to periodically compare said current estimate of said at least one dynamic vehicle operation characteristic with said apriori route information and update said current estimate based on such comparison.

32. The vehicle traffic control system of claim 31 wherein said comparator means includes a recursive estimation filter.

33. The vehicle traffic control system of claim 32 wherein said recursive estimation filter is a Kalman filter.

34. The vehicle traffic control system of claim 26 wherein said current estimate of said at least one dynamic vehicle operating characteristic includes a current position estimate of said respective vehicle.

35. A method of determining the position of a land vehicle travelling over a predetermined route, said method comprising the steps of:

(a) detecting at least one inertial variable of said vehicle utilizing at least one corresponding on-board inertial measurement sensor;

(b) calculating on-board said vehicle a current estimate of at least dynamic vehicle characteristic based on said at least one inertial variable;

(c) periodically receiving benchmark data from a plurality of fixed land positions along said route, said benchmark data containing the specific location of said land position; and (d) periodically updating said current estimate of said at least one dynamic vehicle operating condition based on said benchmark data from said fixed land positions.

36. The method of claim 35 further the following steps:

(e) storing on-board said vehicle apriori route information of said predetermined route;

(f) updating said current estimate of said at least one dynamic vehicle operating characteristic during periods between those updates facilitated by said benchmark data based on said apriori route information.

37. The method of claim 36 further comprising storing estimate data obtained during a complete passage of said vehicle along said predetermined route to provide a basis of subsequent refining of said apriori route information.

38. The method of claim 35 wherein said updates of said current estimate of said at least one dynamic vehicle operating characteristic is performed in step (d) according to a Kalman filter network.

39. The method of claim 35 further comprising the step of:

(g) communicating current estimates of said at least one dynamic vehicle operating characteristic to a central traffic control facility for use in control of traffic flow along said predetermined route, 40. The method of claim 39 further comprising the following steps prior to step (g):

(h) processing input data representative of said current estimate of said at least one dynamic vehicle operating characteristic to produce an output data for communication to said central traffic control facility;

(i) calculating during processing of said input data at least one address check sum and at least one instruction check sum;

(j) comparing said said at least one address check sum and said at least one instruction check sum with respective predetermined check sums;

(k) calculating based said output data an inverse output data;

(l) comparing said inverse output data with said input data; and (m) releasing said output data for communication to said central traffic control facility only if said at least one address check sum and said at least one instruction check sum compare true with said respective predetermined checksums and said inverse output data compares true with said input data.

41. The method of claim 35 wherein said current estimate of said at least one dynamic operating characteristic includes a vehicle position estimate.

42. A method of determining the position of a land vehicle travelling over a predetermined route, said method comprising the steps of:

(a) detecting at least one inertial variable of said vehicle utilizing at least one corresponding on-board inertial measurement sensor;

(b) calculating on-board said vehicle a current estimate of at least dynamic vehicle characteristic based on said at least one inertial variable;

(c) storing on-board said vehicle apriori route information of said predetermined route; and (d) updating said current estimate of said at least one dynamic vehicle operating characteristic based on said apriori route information.

43. The method of claim 42 further the following steps:

(e) periodically receiving benchmark data from a plurality of fixed land positions along said route, said benchmark data containing the specific location of said land position; and (f) periodically updating said current estimate of said at least one dynamic vehicle operating condition based on said benchmark data from said fixed land positions.

44. The method of claim 42 further comprising storing estimate data obtained during a passage of said vehicle along at least a portion of said predetermined route to provide a basis of subsequent refining of said apriori route information.

45. The method of claim 42 wherein said updates of said current estimate of said at least one dynamic vehicle operating characteristic is performed in steps (d) according to a Kalman filter network.

46. The method of claim 42 further comprising the step of:

(g) communicating current estimates of said at least one dynamic vehicle operating characteristic to a central traffic control facility for use in control of traffic flow along said predetermined route.

47. The method of claim 46 further comprising the following steps prior to step (g):

(h) processing input data representative of said current estimate of said at least one dynamic vehicle operating characteristic to produce an output data for communication to said central traffic control facility;

(i) calculating during processing of said input data at least one address check sum and at least instruction check sum;

(j) comparing said said at least one address check sum and said at least one instruction check sum with respective predetermined check sums;

(k) calculating based said output data an inverse output data;

(l) comparing said inverse output data with said input data; and (m) releasing said output data for communication to said central traffic control facility only if said at least one address check sum and said at least one instruction check sum compare true with said respective predetermined checksums and said inverse output data compares true with said input data.

48. The method of claim 42 wherein said current estimate of said at least one dynamic operating characteristic includes a vehicle position estimate.

49. A method of determining the diagnostic condition of a predetermined route traveled by a land-based vehicle, said method comprising the steps of:

(a) detecting at least one inertial variable utilizing at least one corresponding on-board inertial measurement sensor;

(b) calculating on-board said vehicle current estimate of dynamic vehicle characteristics forming a route signature based on said at least one dynamic movement characteristic;

(c) processing said current estimate of vehicle position, motion and attitude to provide a route metric as a function of position; and (d) comparing said route signature with a preselected standard to determine said diagnostic condition of said predetermined route.

50. The method of claim 49 further comprising the following step:

(e) comparing route metrics derived over a sequence of successive passes of said vehicle along portions of said route to determine a change in the diagnostic condition thereof.

51. The method of claim 49 wherein step (c) includes the following steps:

(f) producing a power spectral density signature of said current estimates of said dynamic vehicle operating characteristics; and (g) matching said power spectral density signature with a known signature to produce said route metric.

52. The method of claim 49 wherein said current estimates of said dynamic vehicle operating characteristics includes current estimates of position, motion and vehicle attitude.

53. The method of claim 49 wherein said vehicle is a rail vehicle and said route metric includes the rail characteristics of surface, cross level, alignment and gauge deviation.

* * * * *